United States Patent [19]

Yamada et al.

[11] Patent Number: 4,908,580

[45] **Date of Patent: * Mar. 13, 1990**

[54] VACUUM CHAMBER FOR AN SOR APPARATUS

[75] Inventors: Tadatoshi Yamada; Masatami Iwamoto; Akinori Ohara; Shirou Nakamura, all of Amagasaki; Yuuichi Yamamoto, Kobe, all of Japan

[73] Assignee: Mitsubishi Denki Kabushiki Kaisha, Japan

[ * ] Notice: The portion of the term of this patent subsequent to Apr. 12, 2005 has been disclaimed.

[21] Appl. No.: 307,162

[22] Filed: Feb. 6, 1989

Related U.S. Application Data

[63] Continuation of Ser. No. 43,320, Apr. 28, 1987, abandoned.

[30] Foreign Application Priority Data

May 1, 1986 [JP] Japan ..... 61-99362

[51] Int. Cl.[4] ..... H05H 13/04

[52] U.S. Cl. ..... 328/235

[58] Field of Search ..... 328/235

[56] References Cited

U.S. PATENT DOCUMENTS 4,477,746 10/1984 Piltch ..... 315/39
4,631,743 12/1986 Tomimasu et al. ..... 328/235 X
4,737,727 4/1988 Yamada et al. ..... 328/235

OTHER PUBLICATIONS

Design of UVSOR Storage Ring, Institute for Molecular Science, pp. 56–57, Dec. 1982.

*Primary Examiner*—Palmer C. DeMeo
*Attorney, Agent, or Firm*—Leydig, Voit & Mayer

[57] ABSTRACT

A vacuum chamber for a superconducting SOR apparatus comprises a main chamber through which a beam of charged particles can pass and an SOR chamber which opens onto the inside of the main chamber. The main chamber has a connecting flange formed on each end, and the SOR chamber has a connecting flange formed on its outer end. The dimensions of the vacuum chamber are such that the entire vacuum chamber can fit into the gap between the vacuum tanks of a superconducting bending magnet for the SOR apparatus. The vacuum chamber may further comprise an SOR port in the form of a tube having a flange which connects to the flange of the SOR chamber. The cross-sectional dimensions of the SOR port increase from the inner end which is connected to the SOR chamber to the outer end.

2 Claims, 4 Drawing Sheets

VACUUM CHAMBER FOR AN SOR APPARATUS

This application is a continuation of application Ser. No. 07/043,320 filed Apr. 28, 1987, now abandoned.

BACKGROUND OF THE INVENTION

This invention relates to a vacuum chamber for a superconducting apparatus for producing synchrotron orbital radiation (hereinafter abbreviated as SOR). More particularly, it relates to a vacuum chamber which can be easily installed and removed from a bending magnet of a superconducting SOR apparatus.

Synchrotron orbital radiation is a form of electromagnetic energy which is emitted by charged particles in circular motion at relativistic speeds. It is given off in a continuous spectrum that extends from radio wavelengths through visible light into X-rays. Because of its high intensity, high degree of collimation, broad bandwidth, high polarization, and other properties, it is ideal for a large variety of applications in experimental science and technology.

FIG. 1 illustrates a conventional SOR storage ring 100. The storage ring 100 comprises a loop-shaped main vacuum chamber 1 through which a beam of charged particles (typically an electron beam) passes. A plurality of bending magnets 3 for bending the beam of charged particles are disposed at intervals along the main vacuum chamber 1. When the beam of charged particless is bent by the bending magnets 3, it emits SOR radiation 4 in a direction which is tangential to the orbit of the beam. This radiation 4 is removed from the main vacuum chamber 1 through a plurality of SOR vacuum chambers 2 which open onto the inside of the main vacuum chamber 1 at each of the bending magnets 3. A beam of charged particles 6 at relativistic speeds can be injected into the main vacuum chamber 1 via an incident beam vacuum chamber 5 which opens onto the inside of the main vacuumm chamber 1. The beam 6 is then accelerated and kept orbitting around the main vacuum chamber 1 by unillustrated electromagnets. In order to increase the strength of the SOR 4 which is emitted by the beam of charged particles and to prolong the life-span of the beam which is stored within the storage ring 100, it is important that an extremely high vacuum be maintained inside the main vacuum chamber 1, the SOR vacuum chamber 2, and the incident beam vacuum chamber 5 so that there will be no gas molecules or ions with the vacuum chambers which the beam of charged particles can collide with.

FIG. 2 illustrates the structure of a conventional vacuum chamber 10 for use in a bending magnet 3 for a storage ring 100 of this type, as described in a report entitled "Design of UVSOR Storage Ring", published by the Institute for Molecular Science (UVSOR-9, December, 1982, page 57, in Japanese). This vacuum chamber 10 comprises a main chamber 11 and an SOR chamber 12 which opens onto the inside of the main chamber 11. A beam of charged particles passes through the center of the main chamber 11, while the SOR chamber 12 is positioned such that SOR which is emitted by the beam will pass therethrough. Each end of the main chamber 11 has a connecting flange 14 formed thereon, while the outer end of the SOR chamber 12 has a similar flange 15 formed thereon. The main chamber 11 includes a built-in pump 13. In the figure, the center line 16 indicates the center line of a beam of charged particles passing through the main chamber 11.

The main chamber 11 constitutes a portion of the main vacuum chamber 1 of FIG. 1, and the SOR chamber 12 constitutes a portion of the SOR vacuum chamber 2 of the same figure.

A vacuum chamber 10 of this type is normally installed in a conventional bending magnet 3 in the manner shown in FIGS. 3–5. A conventional bending magnet 3 comprises two sets of exciting coils **3*a* which are wrapped around the poles of a C-shaped iron core 3*b*. The vacuum chamber 10 is inserted into the air gap between the poles of the core 3*b* with the flanges 14 and 15 disposed completely outside of the core 3*b*. Although the flanges 14 and 15 have a diameter which is larger than the height of the gap between the poles of the core 3*b*, since there are no obstructions in the gap, the vacuum chamber 10 can be easily installed and removed from the bending magnet 3**.

However, in the case of an SOR apparatus which employs superconducting electromagnets as bending magnets, the installation and removal of a conventional vacuum chamber can be extremely troublesome. Japanese Patent Application No. 61-28450, of which U.S. Pat. No. 4,737,727 is a counterpart, discloses a superconducting SOR apparatus which employs a superconducting bending magnet 20 of the type illustrated in FIG. 6. The superconducting bending magnet 20 comprises two parallel vacuum tanks 21 in which vacuums are maintained, each of the tans 21 housing a superconducting electromagnetic coil. The upper vacuum tank 21 is supported on the lower one by four support members 22. Vacuums are maintained inside each of the support members 22, and the upper and lower vacuum tanks 21 communicate with one another through the centers of the support members 22. The support members 22 contain structural members made of stainless steel or the like which are maintained at a low temperature and which mechanically support the superconducting coils within the upper and lower vacuum tanks 21. The structural members must be able to withstand electromagnetic forces on the order of several hundred tons which act on the superconducting coils during operation of the SOR apparatus so as to rigidly support the superconducting coils. Liquid helium and liquid nitrogen for cooling the superconducting coils are introduced into the vacuum tanks 21 via intake ports 23 which are supported by a tower 24 which is mounted atop the upper vacuum tank 21. The tower 24 also supports terminals for various electronic instrumentation.

With this type of superconducting bending magnet 20, if a conventional vacuum chamber 10 is installed therein in a manner analogous to that shown in FIG. 3 with the flanges 14 and 15 disposed outside of the bending magnet 20, the support members 22 prevent the vacuum chamber 10 from being easily inserted or removed from the bending magnet 20. Namely, because of the length of the main chamber 11 and the large diameter of the flanges 14 and 15, which is larger than the height of the gap betwen the vacuum tanks 21, it is necessary to partially disassemble the bending magnet 20 in order to insert or remove the vacuum chamber 10 from between the vacuum tanks 21. Because of the far lower pressure which must be maintained in the vacuum chamber 10 (at most $1\times10^{-9}$ torr in the vacuum chamber 10 vs about $1\times10^{-6}$ torr in the vacuum tanks 21), the vacuum chamber 10 is more prone to leaks and requires more frequent repair or replacement than the vacuum tanks 21. Nevertheless, with the conventional structure, it is necessary to disassemble the latter in order to service the former.

SUMMARY OF THE INVENTION

Accordingly, it is an object of the present invention to provide a vacuum chamber for a superconducting SOR apparatus which can be easily installed in and removed from a superconducting bending magnet of the SOR apparatus without it being necessary to disassemble the bending magnet.

A vacuum chamber according to the present invention is for an SOR apparatus of the type having a superconducting bending magnet with two separate vacuum tanks which confront one another across a gap and are connected by a plurality of support members which resist the attractive forces acting on the coils during operation. The vacuum chamber comprises a main chamber through which a beam of charged particles passes and an SOR chamber whose inner end opens onto the inside of the main chamber. The main chamber has connecting flanges formed on the ends thereof, and the SOR chamber has a connecting flange formed on its outer end. The flanges are smaller in diameter than the height of the gap between the vacuum tanks, and the dimensions of the vacuum chamber are such that it is entirely contained within the gap. Therefore, the vacuum chamber can be easily inserted into and removed from the gap between the vacuum tanks without disassembling the bending magnet.

A vacuum chamber according to the present invention may further comprise an SOR port for SOR which is connected to the SOR chamber. The SOR port has a flange at its inner end which is connected to the flange of the SOR chamber, and the cross-sectional dimensions of the SOR port increase from the inner end to its outer end.

BRIEF DESCRIPTION OF THE DRAWINGS

In the figures, the same reference numerals indicate the same or corresponding parts.

DESCRIPTION OF THE PREFERRED EMBODIMENTS

Figure 1:
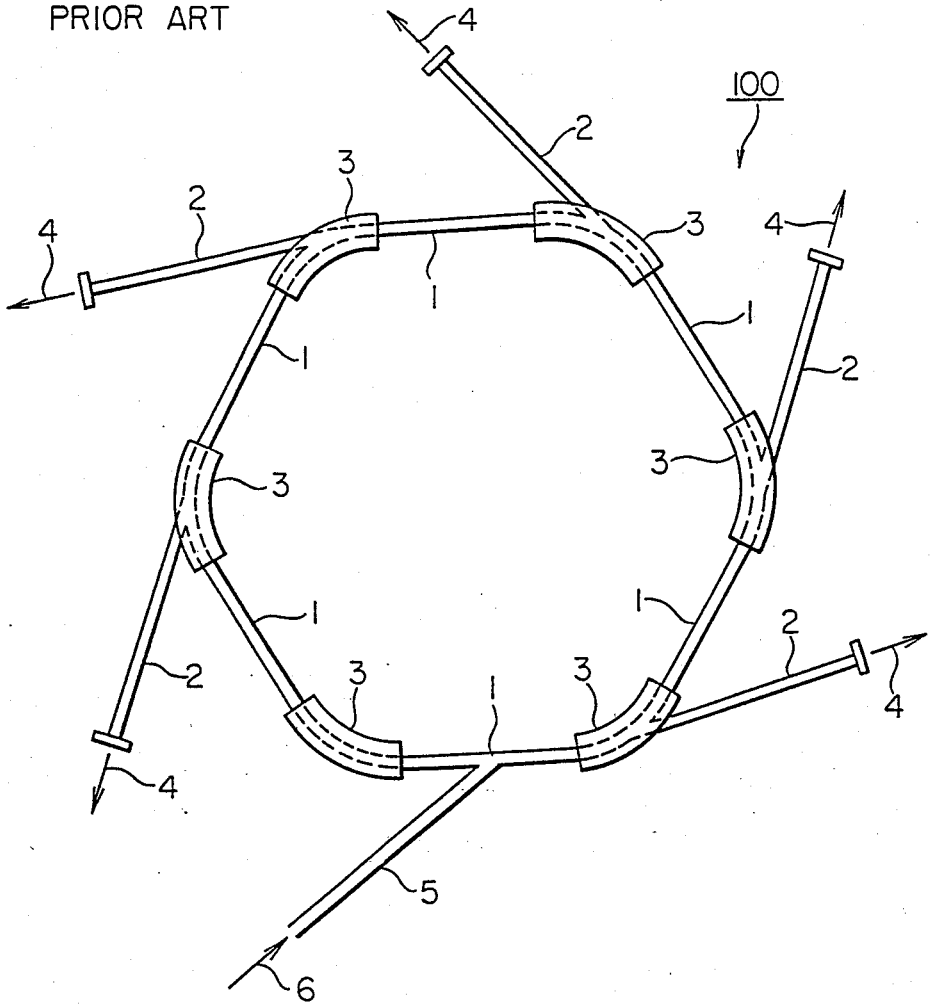
FIG. 1 PRIOR ART
FIG. 1 is a schematic plan view of a conventional SOR storage ring.
Figure 2:
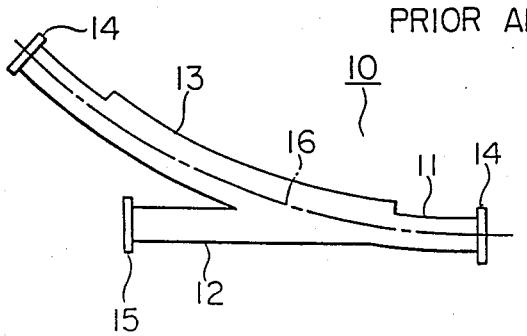
FIG. 2 PRIOR ART
FIG. 2 is a schematic plan view of a conventional vacuum chamber for an SOR storage ring of the type shown in FIG. 1.
Figure 3:
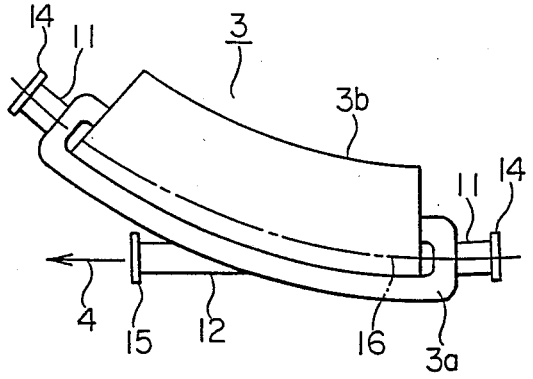
FIG. 3 PRIOR ART
FIG. 3 is a schematic plan view of a conventional bending magnet for an SOR apparatus employing the vacuum chamber of FIG. 2.
Figure 4:
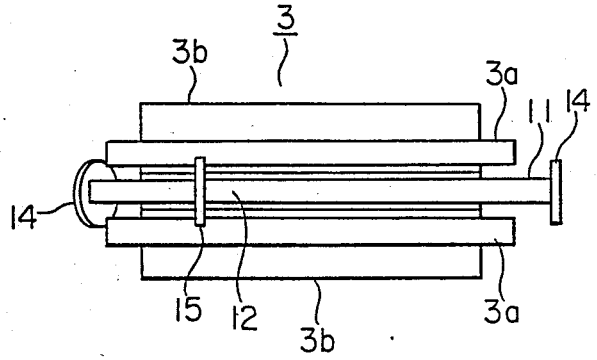
FIG. 4 PRIOR ART
FIG. 4 is a front view of the bending magnet of FIG. 3.
Figure 5:
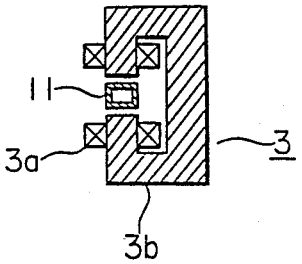
FIG. 5 PRIOR ART
FIG. 5 is a schematic transverse cross-sectional view of the bending magnet of FIG. 3.
Figure 6:
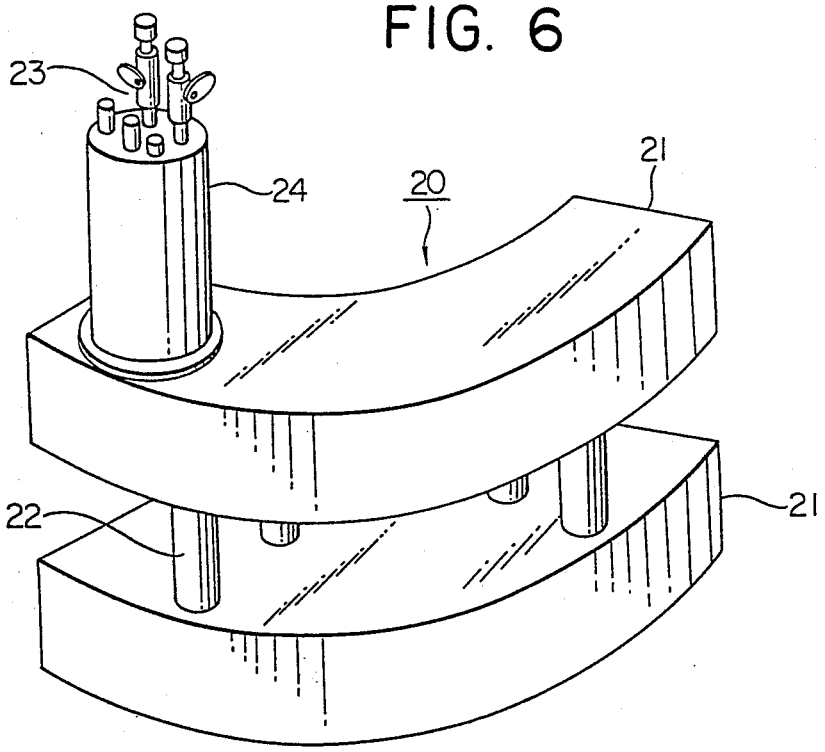
FIG. 6 is a perspective view of a superconducting bending magnet of the type to which the present invention is applied.
Figure 7:
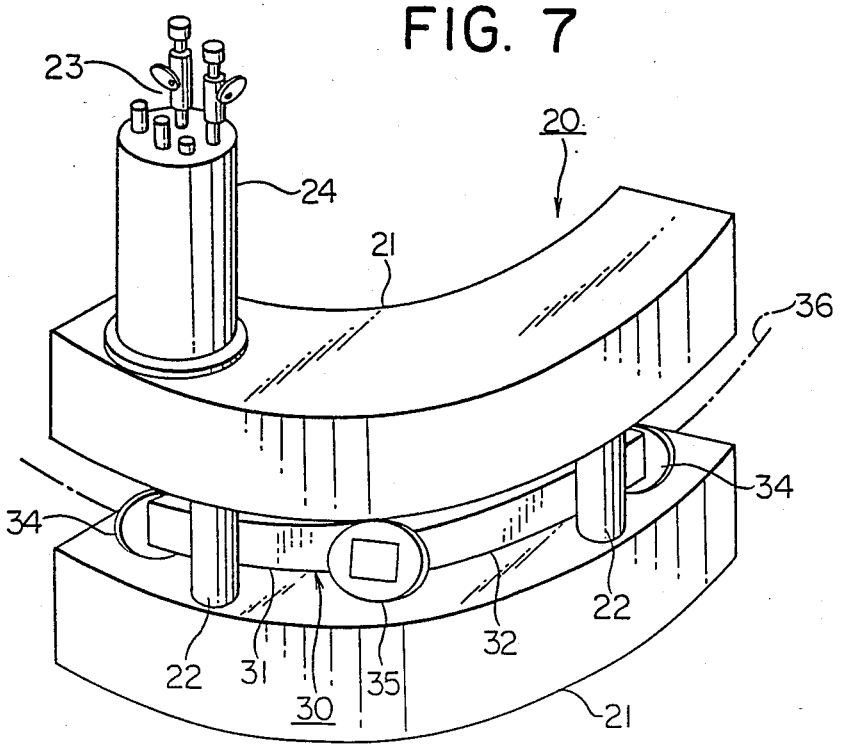
FIG. 7 is a perspective view of a vacuum chamber in accordance with a first embodiment of the present invention as installed in the superconducting bending magnet of FIG. 6.
Figure 8:
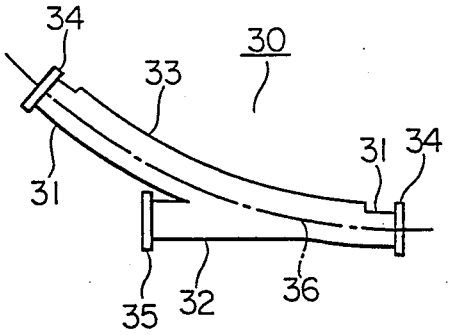
FIG. 8 is a schematic plan view of the vacuum chamber of FIG. 7.

Hereinbelow, two preferred embodiments of a vacuum chamber in accordance with the present invention will be described while referring to FIGS. 7–9 of the accompanying drawings. FIG. 7 illustrates a first embodiment of a vacuum chamber 30 installed in a superconducting bending magnet 20 which is identical to the one shown in FIG. 6, and FIG. 8 is a schematic plan view of this embodiment. As can be seen from FIG. 8, this vacuum chamber 30 has the same basic structure as the conventional vacuum chamber 10 of FIG. 2. It comprises a main chamber 31 through which a beam of charged particles passes, and an SOR chamber 32 which opens onto the inside of the main chamber 31. The SOR chamber 32 is located in a position such that SOR which is emitted from a beam of charged particles passing through the main chamber 31 will pass through the SOR chamber 32. The main chamber 31 includes a conventional built-in pump 33 and has a connecting flange 34 formed on each end. Similarly, the SOR chamber 32 has a connecting flange 35 formed on its outer end. The center line 36 in the figure indicates the center line of the orbit of a beam of charged particles.

In contrast to a conventional vacuum chamber, the vacuum chamber 30 according to the present invention has dimensions such that it can fit entirely into the space between the vacuum tanks 21 of a superconducting bending magnet 20. The diameters of the flanges 34 and 35 are smaller than the height of the support members 22 between the two vacuum tanks 21, and are also smaller than the distance between adjacent support members 22 of the superconducting bending magnet 20. Accordingly, the vacuum chamber 30 can be moved along the center line 36, and it can be easily inserted into or removed from the sace between the two vacuum tanks 21 without it being necessary to disassemble any part of the superconducting bending magnet 20.

Figure 9:
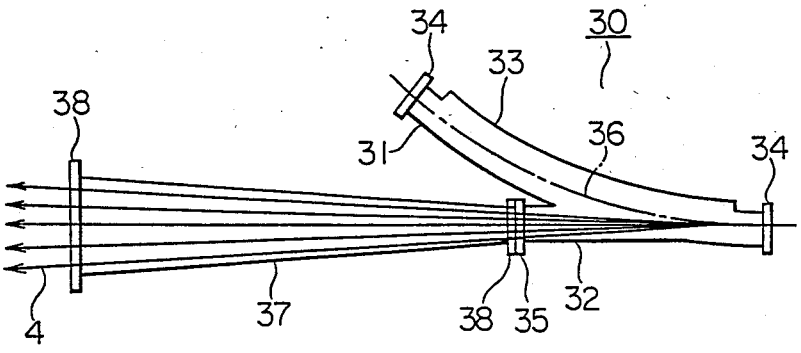
FIG. 9 is a schematic plan view of a second embodiment of a vacuum chamber in accordance with the present invention which is equipped with a port for SOR.

FIG. 9 illustrates a second embodiment of a vacuum chamber 30 in accordance with the present invention. This embodiment further comprises an SOR port 37 which is connected to the outer end of the SOR chamber 32. The SOR port 37 has connecting flanges 38 formed on each end thereof, the inner of which abuts against and is connected to the flange 35 of the SOR chamber 32. When SOR 4 is emitted from the beam of charged particles within the main chamber 31, it diverges in the manner illustrated in FIG. 9. Therefore, the cross-sectional dimensions of the SOR port 37 increase from the inner end, which is connected to the flange 35 of the SOR chamber 32, to the outer end. The structure of this embodiment is otherwise identical to that of the previous embodiment. Like the previous embodiment, it can be easily inserted into and removed from the space between the vacuum tanks 21 of a superconducting bending magnet 20 without it being necessary to disassemble the magnet 20. If necessary, the SOR port 37 can be easily disconnected from the SOR chamber 32 of the vacuum chamber 30 by disconnecting the flanges 35 and 38 from one another.

What is claimed is:

1. A vacuum chamber for an SOR apparatus of the type having a superconducting bending magnet having two confronting superconducting coils, each of which is housed in a separate vacuum container, said vacuum containers having a gap therebetween and being connected with one another by a plurality of support members which extend across said gap and resist the attractive forces acting on said superconducting coils during the operation of said housing magnet, said vacuum chamber comprising:

a main chamber through which a beam of charged particles can pass, said main chamber having a connecting flange formed on each end thereof; and an SOR chamber for synchrotron orbital radiation, the inner end of said SOR chamber opening onto the inside of said main chamber and the outer end of said SOR chamber having a connecting flange formed thereon, said SOR chamber being positioned such that SOR which is emitted by a beam passing through said main chamber can pass through said SOR chamber, wherein said connecting flanges of said main chamber and said connecting flange of said SOR chamber all lie within said gap between said two separate vacuum containers and the diameter of each of said flanges is less than the distance between adjacent of said support members.

2. A vacuum chamber as claimed in claim 1, further comprising:

an SOR port for synchrotron orbital radiation comprising a tube having a flange formed on its inner end which is connected to said flange on said SOR chamber, the transverse cross-sectional area of said SOR port increasing from said inner end towards the outer end thereof.

* * * * *

UNITED STATES PATENT AND TRADEMARK OFFICE

CERTIFICATE OF CORRECTION

PATENT NO. : 4,908,580

DATED : March 13, 1990

INVENTOR(S) : Yamada et al

It is certified that error appears in the above-identified patent and that said Letters Patent is hereby corrected as shown below:

Col. 5, line 3, change "housing" to --bending--.

Signed and Sealed this

Seventeenth Day of March, 1992

*Attest:*

*Attesting Officer*

HARRY F. MANBECK, JR.

*Commissioner of Patents and Trademarks*